US012728333B2

(12) United States Patent
McCoy et al.

(10) Patent No.: US 12,728,333 B2
(45) Date of Patent: Sep. 8, 2026

(54) MOBILE AND FOLDABLE BASKETBALL BACKBOARD AND HOOP SYSTEM

(71) Applicants: Kenneth McCoy, Brambleton, VA (US); Daren Thorpe, Staunton, VA (US)

(72) Inventors: Kenneth McCoy, Brambleton, VA (US); Daren Thorpe, Staunton, VA (US)

( * ) Notice: Subject to any disclaimer, the term of this patent is extended or adjusted under 35 U.S.C. 154(b) by 136 days.

(21) Appl. No.: 18/982,777

(22) Filed: Dec. 16, 2024

(65) Prior Publication Data

US 2026/0166400 A1 Jun. 18, 2026

(51) Int. Cl.
*A63B 63/08* (2006.01)

(52) U.S. Cl.
CPC ..... *A63B 63/083* (2013.01); *A63B 2210/50* (2013.01)

(58) Field of Classification Search
CPC ..... A63B 63/083; A63B 2210/50
See application file for complete search history.

(56) References Cited

U.S. PATENT DOCUMENTS 4,036,494 A 7/1977 Hayes
5,069,441 A * 12/1991 Fang ..... A63B 63/083 473/485
5,096,191 A * 3/1992 Fang ..... A63B 63/083 273/400
2009/0191988 A1* 7/2009 Klein ..... A63B 24/0021 473/480
2010/0304903 A1 12/2010 Quinn
2016/0082330 A1 3/2016 Barnes
2020/0122010 A1* 4/2020 Brey ..... A63B 71/023

OTHER PUBLICATIONS

D. Burkhalter D. Simulation-Driven Design of a Portable Basketball Hoop System. Proceedings. 2020; 49(1):131 (Year: 2020).*

* cited by examiner

*Primary Examiner* — Amber A Misiaszek
(74) *Attorney, Agent, or Firm* — Stanzione & Associates, PLLC; Patrick Stanzione

(57) ABSTRACT

A mobile basketball backboard and hoop system that is foldable into two halves for compact travel. The backboard includes a hole extending through each of the two halves thereof with a net attached to each of the two holes to catch an object that is tossed through one of the holes. The hoop is configured to be easily attached to and detached from the backboard. A pivotal support is fixed to the back side of each foldable half of the back of the backboard to support the backboard in an upright position when unfolded. A top net extends above the backboard to catch any objects that are thrown over the top of the backboard.

12 Claims, 3 Drawing Sheets

MOBILE AND FOLDABLE BASKETBALL BACKBOARD AND HOOP SYSTEM

STATEMENT REGARDING FEDERALLY SPONSORED RESEARCH OR DEVELOPMENT

Not applicable.

COPYRIGHT NOTICE

A portion of this disclosure contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever. 37 C.F.R 1.71(d).

BACKGROUND OF THE INVENTIVE CONCEPT

1. Field of the Invention

The present inventive concept relates to a mobile and foldable basketball backboard and hoop system, and more specifically, to a mobile and foldable basketball backboard and hoop system that provides features to gain points as well as features to deduct points when playing a game by tossing a ball at the basketball backboard and hoop system.

Description of the Related Art

Mobile entertainment games are enjoyable and convenient to use at any location, as they can be easily taken to any location, such as traveling for a vacation, while visiting friends, or simply moving the game from one location to another within a user's home or office. Specifically, mobile entertainment games that can easily be folded up and unfolded for relocation are desirable as they can be quickly assembled upon arriving at any location in which such games are intended to be played and then simply folded back up when leaving such locations.

Miniature basketball games are especially popular for entertainment use within a building or other structure during inclement weather, or can even be taken to an outdoor location during good weather to play with other during outdoor parties. Mobile basketball games in general have been provided for such entertainment use, as described below.

US Publication Number: 2016/0082330 to Barnes discloses an indoor basketball game system 100 including a three paneled foldable backboard 108 with a basketball hoop 104 disposed on it. Further, a winged deflector 106 is disposed on the ground adjacent the bottom of the backboard 108 and inclined upwards on the board from the bottom edge to form a ball return feature. The winged deflector 106 allows repeated shooting without the need to chase the ball after being shot at the system 100. This system 100 by Barnes is a simple basketball game for shooting a ball at a hoop 104 to make a basket. The outer panels can be folded in over the middle panel for storage and transport.

U.S. Pat. No. 4,036,494 by Hayes discloses a basketball game device adapted for use in a room of a home or the like. This device includes a backboard 12 with wings 14, 16 that respectively support telescoping poles 24, 30 for supporting the backboard 12 at various adjustable positions. Similar to Barnes, the device by Hayes provides a simple basketball game for shooting a ball at a hoop 18 to make a basket.

US Patent Publication Number: 2010/0304903 by Quinn discloses a miniature basketball hoop 10 including a backboard 16 and a pair of hooks 20 on the top of the backboard 16 to hook the backboard 16 over the top of a door. Although this miniature basketball hoop 10 is mobile, it is limited to hanging over the top of a door and only includes a hoop 32 to receive a tossed miniature basketball therethrough. This miniature basketball hoop 10 is not foldable for easy transportation.

Accordingly, there is a need for a mobile and foldable basketball backboard and hoop system that can provide a hoop to collect points when a basketball is tossed through the hoop and traps between a hoop that will catch a basketball to count as deducted points.

There is also a need for a mobile and foldable basketball backboard and hoop system that can provide two foldable panels to dispose a basketball hoop at direct center when folded to a specific angle for accumulating points while providing traps with nets disposed at each side of the basketball hoop for deducting points when a tossed basketball is caught within the traps.

There is also a need for a mobile and foldable basketball backboard and hoop system that can provide a netting structure that extends above a backboard and hoop combination to stop a tossed basketball from overshooting the backboard.

There is also a need for a mobile and foldable basketball backboard and hoop system that includes foldable legs disposed at a back side of the backboard to keep the mobile and foldable basketball backboard and hoop system in an upright position while being used for gaming purposes and foldable against the backboard when transporting the mobile and foldable basketball backboard and hoop system.

SUMMARY OF THE INVENTIVE CONCEPT

The present general inventive concept provides a mobile and foldable basketball backboard and hoop system, and more specifically, to a mobile and foldable basketball backboard and hoop system that provides features to gain points as well as features to deduct points when playing a game by tossing a ball at the basketball backboard and hoop system.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a mobile and foldable basketball backboard and hoop system, comprising: a backboard configured to have a foldable section at a middle section thereof be foldable into two equal sized halves, the backboard including: a ball receiving hole disposed through each of the two halves of the backboard, each ball receiving hole including a net fixed around a circumference thereof to catch a ball that passes therethrough, and at least one screw hole disposed through at least one of the two halves of the backboard below the corresponding ball receiving hole and closer to the foldable section than the ball receiving hole; a basketball hoop configured to be attachable to one of the two equal halves of the backboard at the screw hole; a leg attached to a rear side of each half of the backboard and configured to be pivotal against and away from the respective half of the backboard such that each leg pivots away from the respective half of the backboard to support the backboard in an upright position; and a top net detachably connectable across a top portion of the backboard.

In an exemplary embodiment, the mobile and foldable basketball backboard and hoop system can further include a screw and wingnut combination to connect the basketball hoop to one of the two equal halves of the backboard at the corresponding screw hole.

In another exemplary embodiment, the mobile and foldable basketball backboard and hoop system can further include a hinge disposed between the two equal sized halves of the backboard to enable the backboard to fold between open and folded positions.

In another exemplary embodiment, the mobile and foldable basketball backboard and hoop system can further include a pole extending horizontally upward from opposite ends of the backboard to receive and retain first and second ends of the top net.

In another exemplary embodiment, the pole comprises an adjustable clamp and pole combination attached to opposite ends of the back side of the backboard, wherein the clamp includes a screw to loosen and tighten the respective pole at different heights.

In still another exemplary embodiment, the top net can include tubes connected to the first and second ends thereof, each tube configured to slide over a respective one of the posts.

The foregoing and/or other features and utilities of the present general inventive concept may also be achieved by providing a mobile basketball game system, comprising: a foldable backboard including: a ball receiving hole disposed through each of two foldable halves of the backboard, each ball receiving hole including a net fixed around a circumference thereof to catch a ball that passes through the respective ball receiving hole, and a fastening device attachable to at least one of the two foldable halves of the backboard below the corresponding ball receiving hole and closer to the other one of the two foldable halves; a basketball hoop attachable to one of the two foldable halves of the backboard by the fastening device; a pivotable leg attached to a rear side of each foldable half of the backboard to support the backboard in an upright position; and a top net detachably connectable across a top portion of the backboard.

In an exemplary embodiment, the basketball hoop can include a support plate with at least one hole fixed thereto to receive the fastening device, at least one half of the foldable backboard includes at least one hole to receive the fastening device, and the fastening device can include a threaded screw and wingnut to attach the support plate to the backboard through the at least one hole in the support plate and through the at least one hole in the at least one half of the foldable backboard.

In another exemplary embodiment, the mobile basketball game system can further include a hinge disposed between the two foldable halves of the backboard to enable the backboard to fold between open and folded positions.

In still another exemplary embodiment, the top net can include a tube connected to the first and second ends thereof, and the backboard can include an adjustable clamp and pole combination fixed to rear opposite ends thereof, wherein the pole is configured to be adjustable to be raised and inserted into a respective one of the tubes connected to the first and second ends of the top net.

In still another exemplary embodiment, the fastening device can include a magnet attached to a backside of at least one of the two foldable halves of the backboard to magnetically attach the support plate to the backboard.

In yet another exemplary embodiment, the fastening device can include a bracket attached to the backboard to receive and retain the support plate therein.

BRIEF DESCRIPTION OF THE DRAWINGS

These and/or other features and utilities of the present inventive concept will become apparent and more readily appreciated from the following description of the embodiments, taken in conjunction with the accompanying drawings of which.

Figure 1:
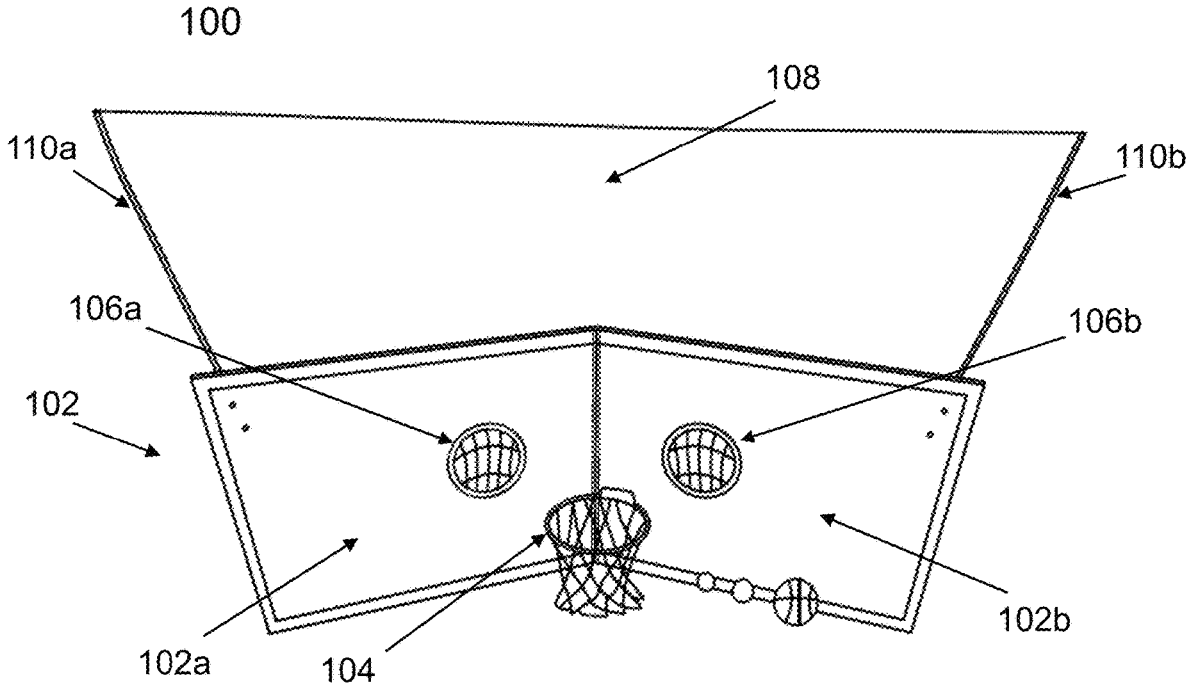
FIG. 1 illustrates a perspective downward view of a mobile and foldable basketball backboard and hoop system according to an example embodiment of the present inventive concept.

The drawings illustrate a few example embodiments of the present inventive concept and are not to be considered limiting in its scope, as the overall inventive concept may admit to other equally effective embodiments. The elements and features shown in the drawings are to scale and attempt to clearly illustrate the principles of exemplary embodiments of the present inventive concept. In the drawings, reference numerals designate like or corresponding, but not necessarily identical, elements throughout the several views.

DETAILED DESCRIPTION OF THE PREFERRED EMBODIMENTS

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures. Also, while describing the present general inventive concept, detailed descriptions about related well-known functions or configurations that may diminish the clarity of the points of the present general inventive concept may be omitted.

It will be understood that although the terms “first” and “second” are used herein to describe various elements, these elements should not be limited by these terms. These terms are only used to distinguish one element from another element. Thus, a first element could be termed a second element, and similarly, a second element may be termed a first element without departing from the teachings of this disclosure.

Expressions such as "at least one of," when preceding a list of elements, modify the entire list of elements and do not modify the individual elements of the list.

All terms including descriptive or technical terms which are used herein should be construed as having meanings that are obvious to one of ordinary skill in the art. However, the terms may have different meanings according to an intention of one of ordinary skill in the art, case precedents, or the appearance of new technologies. Also, some terms may be arbitrarily selected by the applicant, and in this case, the meaning of the selected terms will be described in detail in the detailed description herein. Thus, the terms used herein have to be defined based on the meaning of the terms together with the description throughout the specification.

Also, when a part "includes" or "comprises" an element, unless there is a particular description contrary thereto, the part can further include other elements, not excluding the other elements.

Hereinafter, one or more exemplary embodiments of the present general inventive concept will be described in detail with reference to accompanying drawings.

Example embodiments of the present general inventive concept are directed to an.

FIG. 1 illustrates a perspective view of a mobile and foldable basketball backboard and hoop system 100 according to an example embodiment of the present inventive concept. Referring to FIG. 1, a foldable backboard 102 for a miniature sized basketball game can be formed of two equally sized wings 102*a* and 102*b* that are configured to be folded over each other. The foldable backboard 102 can be formed of a solid material such as plastic, fiberglass, cardboard, or any other similar type material that will perform the intended purposes of providing a solid lightweight backboard that will withstand the impact of a miniature basketball being tossed against it as well as supporting a basketball hoop 104 attached thereto, and to support legs 112*a*-112*b* (see FIG. 4) attached thereto and netting support poles 110*a*-110*b* extending therefrom. The equally sized wings 102*a* and 102*b* can be foldable over each other via a foldable crease formed down the middle of the backboard 102 or can be attached to each other via one of more hinges 103 (see FIG. 2). The hinge 103 is provided to enable the two wings 102*a*,102*b* to fold over each other to reduce the size of the foldable basketball backboard and hoop system 100 to half of the width of the backboard 102. It is to be noted that when the backboard 102 is formed of a cardboard or other foldable plastic type material the crease can be formed directly down the center of the backboard to enable folding the two wings 102*a*,102*b* over each other, thus not requiring the use of a hinge 103.

According to an example embodiment each of the two wings 102*a*, 102*b* can include a hole 106*a*, 106*b* extending therethrough, respectively. Each hole 106*a*, 106*b* can include a net attached around a circumference of the hole 106 *a*, 106 *b* at the back side of the wings 102*a*,102*b* to receive and retain a ball therein that has passed through (tossed) the hole 106*a*, 106*b* from a front side of the backboard 102. Each hole 106*a*, 106*b* is preferably disposed equally off center toward the hinge 103 (or crease). Attached to one of the two wings 102*a*,102*b* can be a miniature sized basketball hoop 104 with a net attached thereto. The hoop 104 is preferably attached to a wing 102*a*,102*b* closer to the hinge 103 (or crease) than the corresponding hole 106*a* or 106*b* of the respective wing 102*a*,102*b*. The hoop 104 is preferably attached to one of the wings 102*a*,102*b* such that when the wings 102*a*,102*b* are folded opened away from each other to an angle slightly less than 180 degrees, the hoop 104 will be positioned directly in front of the hinge 103 (or crease) and directly between and below the two holes 106*a*,106*b*. With this configuration when a basketball (or other gaming ball) is tossed toward the backboard 102 with the intention of putting the basketball through the hoop 104 one hole 106*a* will be disposed directly to the left and above the hoop 104 while the other hole 106*b* will be disposed directly to the right and above the hoop 104. If the tossed basketball goes through the hoop 104 a point can be added for the player tossing the basketball. However, if the tossed basketball goes through one of the holes 106*a*,106*b* instead a point can be deducted from the player tossing the basketball.

Figure 2:
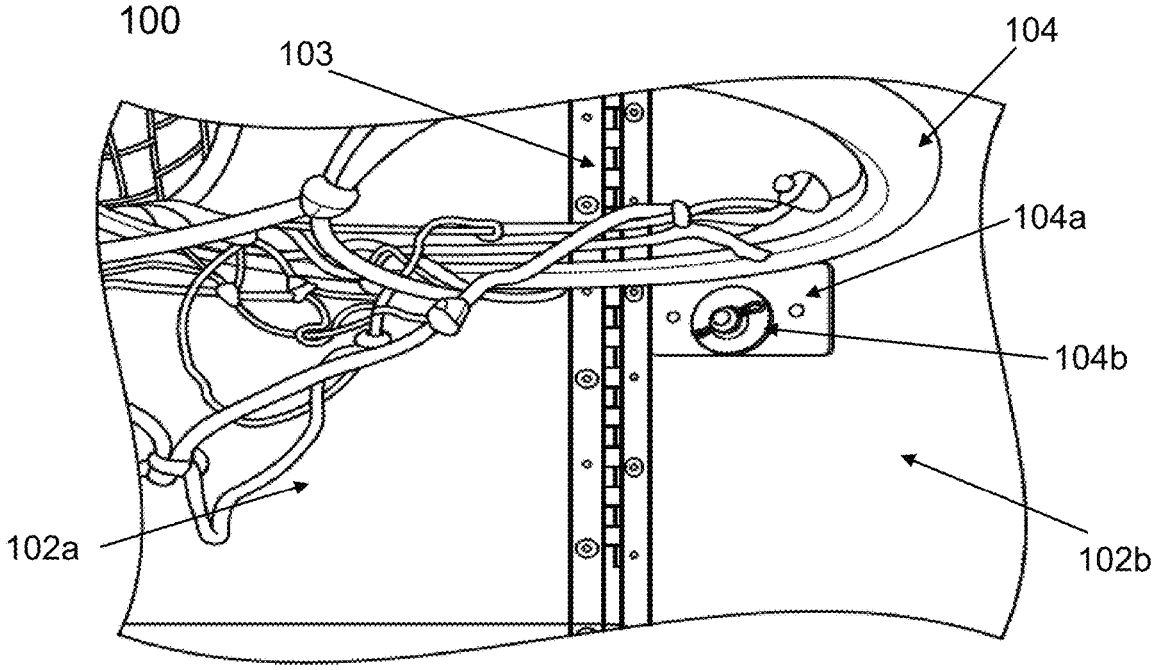
FIG. 2 illustrates a detachable basketball hoop attached to the backboard of the mobile and foldable basketball backboard and hoop system according to the example embodiment of FIG. 1.

FIG. 2 illustrates a detachable basketball hoop 104 configured as being attached to one of the wings 102*a*,102*b* of the foldable backboard 102, according to an example embodiment of the present inventive concept. Referring to FIG. 2, the hoop 104 can include a support plate 104*a* which is attached to the hoop 104 and configured to sit flat against the backboard 102 while the hoop 104 extends perpendicular to the backboard 102, thus providing a perfectly horizontal hoop 104 extending in front of the backboard 102 to receive a basketball (or other miniature game balls) therethrough. The support plate 104*a* can include one or more holes extending therethrough to receive a corresponding screw and wingnut combination 104*b*. Similarly, at least one of the wings 102*a*,102*b* can include one or more holes extending therethrough to receive the screw(s) therethrough such that the screw and wingnut combination 104*b* (or other similar connection mechanism) can tightly secure the hoop 104 to the backboard 102. It is noted that other similar attachment mechanisms can be used alternatively to attach the hoop 104 to one of the wings 102*a*,102*b* of the backboard 102 without departing from the spirit and scope of the overall present inventive concept, such as, for example a magnet attached to the back of the backboard to magnetically attach the support plate 104*a* to the backboard, or a bracket in which the support plate 104*a* can be inserted into the retain the support plate 104*a* against the backboard 102.

Figure 3:
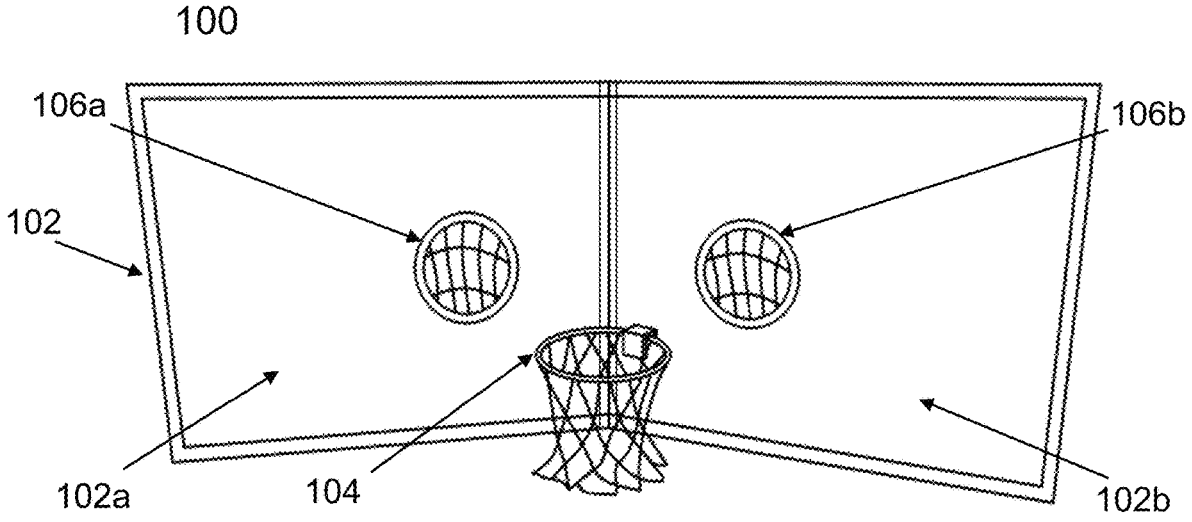
FIG. 3 illustrates a front view of the mobile and foldable basketball backboard and hoop system according to an example embodiment of FIG. 1.

FIG. 3 illustrates a front view of the mobile and foldable basketball backboard and hoop system 100 according to an example embodiment of FIG. 1. As illustrated in FIG. 3, when the backboard 102 is opened from a folded position and the hoop 104 is attached to the right wing 102*b*, the backboard should be opened to an angle less than 180 degrees to an extent that the hoop 104 will be centered with respect to the hole 106*a* and the hole 106*b*, which will result in the hoop 104 being positioned directly in front of the hinge 103 (or crease) between the wing 102*a* and the wing 102*b*. Once the backboard 102 is unfolded additional features are provided to ensure that the backboard 102 remains upright during game play, as illustrated in FIG. 4.

Figure 4:
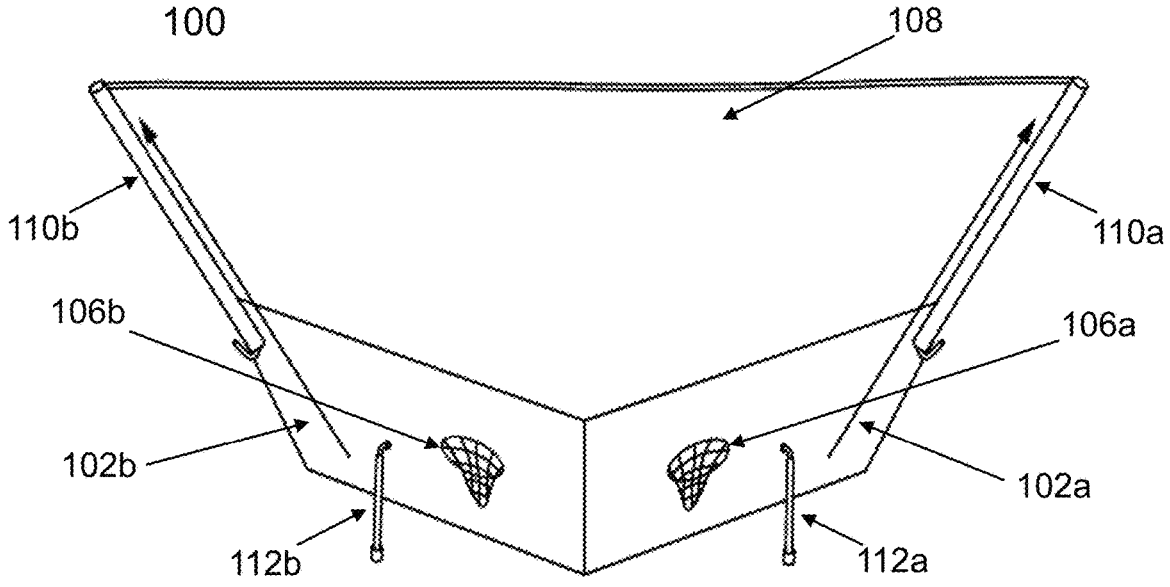
FIG. 4 illustrates a rear downward view of the mobile and foldable basketball backboard and hoop system according to an example embodiment of FIG. 1.

FIG. 4 illustrates a rear downward view of the mobile and foldable basketball backboard and hoop system 100 according to an example embodiment of FIG. 1. Referring to FIG. 4, at the back of each wing 102*a*,102*b* can be disposed a pivotal leg 112*a*,112*b* connected thereto. The legs 112*a*,112*b* can be connected at one end to a hinge type feature which attaches to the back of the wings 102*a*,102*b* and enables the legs 112*a*,112*b* to pivot outward by an amount to support the backboard 102 in an upright position. The legs 112*a*,112*b* can be made of hollow aluminum poles attached at one end to the hinge that can then be screwed or adhered to the back of the backboard 102. Alternatively, the legs 112*a*,112*b* can be formed of any alternative equivalent material that will pivot outward to perform the intended purposes as described herein, without departing from the spirit and scope of the overall present inventive concept.

Still referring to FIG. 4, a netting 108 with end supports 110*a*,110*b* can be removably attached above the backboard 102 by connecting the supports 110*a*,110*b* to opposite ends of the back of the backboard 102 such that the netting 108 will extend upward from the backboard 102 to catch balls that are tossed above the backboard 102 to prevent the tossed ball from rolling too far from the foldable basketball backboard and hoop system 100. An example of a device that can be used to receive and attach the supports 110*a*,110*b* to opposite ends of the back of the backboard 102 is illustrated in FIG. 5, as described below.

Figure 5:
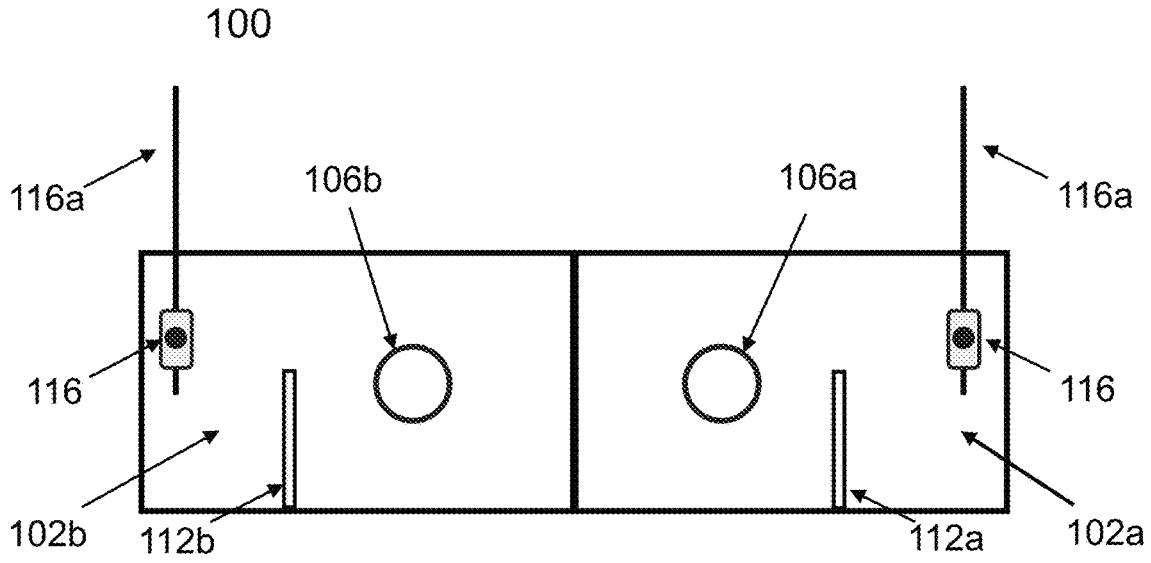
FIG. 5 illustrates a rear elevated view of the mobile and foldable basketball backboard and hoop system 100 according to an example embodiment of FIG. 1.

FIG. 5 illustrates a rear elevated view of the mobile and foldable basketball backboard and hoop system 100 according to an example embodiment of FIG. 1. As illustrated in FIG. 5, an example of a device to removably attach and adjust the supports 110*a*,110*b* to the back of the backboard 102 can include an adjustable clamp 116 and pole 116*a* combination, such as one that is commonly used for drums to adjust the height of the legs on a drum. The adjustable clamp 116 can be adhered to the back of each foldable half 102*a*,102*b* of the backboard 102 at outer sides thereof, respectfully. The adjustable clamps 116 can each include a screw that can be rotated to tighten against a respective pole 116*a* that is inserted into the clamp 116 or rotated to loosen the pole 116*a* so that the pole 116*a* can be easily raised or lowered, therefore easily enabling the poles 116 *a* to be raised to receive a respective support 110*a*,110*b* or lowered to be disposed entirely behind the backboard 102 so that the entire mobile and foldable basketball backboard and hoop system 100 can be folded up and stored or transported.

Figure 6:
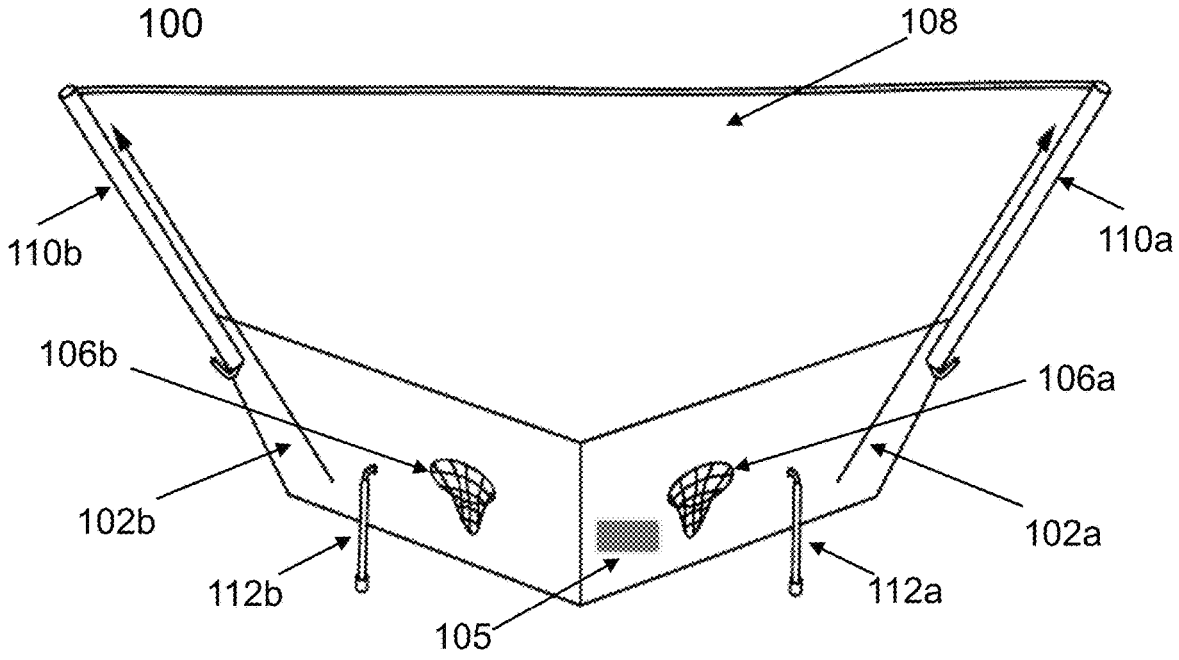
FIG. 6 illustrates a rear downward view of the mobile and foldable basketball backboard and hoop system according to another example embodiment of FIG. 1.

FIG. 6 illustrates a rear downward view of the mobile and foldable basketball backboard and hoop system 100 according to another example embodiment of FIG. 1. Referring to FIG. 6, a magnet 105 can be fixed to at least one back side of the backboard 102 to magnetically attach the metal hoop 104 to at least one of two foldable halves 102*a*,102*b* of the backboard 102. The magnet 105 can be attached at a position below a corresponding hole 106*a*,106*b* extending through a corresponding half 102*a*,102*b* of the backboard 102 and closer to the folding hinge (or crease) between the first and second halves 102*a*,102*b* of the backboard 102.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A mobile and foldable basketball backboard and hoop system, comprising:

a backboard configured to have a foldable section at a middle section thereof be foldable into two equal sized halves, the backboard including:

a ball receiving hole disposed through each of the two halves of the backboard, each ball receiving hole including a net fixed around a circumference thereof to catch a ball that passes therethrough, and at least one screw hole disposed through at least one of the two halves of the backboard below the corresponding ball receiving hole and closer to the foldable section than the ball receiving hole;

a basketball hoop configured to be attachable to one of the two equal halves of the backboard at the screw hole;

a leg attached to a rear side of each half of the backboard and configured to be pivotal against and away from the respective half of the backboard such that each leg pivots away from the respective half of the backboard to support the backboard in an upright position; and a top net detachably connectable across a top portion of the backboard.

2. The mobile and foldable basketball backboard and hoop system in accordance with claim 1, further comprising a screw and wingnut combination to connect the basketball hoop to one of the two equal halves of the backboard at the corresponding screw hole.

3. The mobile and foldable basketball backboard and hoop system in accordance with claim 1, further comprising a hinge disposed between the two equal sized halves of the backboard to enable the backboard to fold between open and folded positions.

4. The mobile and foldable basketball backboard and hoop system in accordance with claim 1, further comprising a pole extending horizontally upward from opposite ends of the backboard to receive and retain first and second ends of the top net.

5. The mobile and foldable basketball backboard and hoop system in accordance with claim 4, wherein the top net comprises tubes connected to the first and second ends thereof, each tube configured to slide over a respective one of the posts.

6. The mobile and foldable basketball backboard and hoop system in accordance with claim 4, wherein the pole comprises an adjustable clamp and pole combination attached to opposite ends of the back side of the backboard, wherein the clamp includes a screw to loosen and tighten the respective pole at different heights.

7. A mobile basketball game system, comprising:

a foldable backboard including:

a ball receiving hole disposed through each of two foldable halves of the backboard, each ball receiving hole including a net fixed around a circumference thereof to catch a ball that passes through the respective ball receiving hole, and a fastening device attachable to at least one of the two foldable halves of the backboard below the corresponding ball receiving hole and closer to the other one of the two foldable halves;

a basketball hoop attachable to one of the two foldable halves of the backboard by the fastening device;

a pivotable leg attached to a rear side of each foldable half of the backboard to support the backboard in an upright position; and a top net detachably connectable across a top portion of the backboard.

8. The mobile basketball game system in accordance with claim 7, wherein:

the basketball hoop includes a support plate with at least one hole fixed thereto to receive the fastening device, at least one half of the foldable backboard includes at least one hole to receive the fastening device, and the fastening device includes a threaded screw and wingnut to attach the support plate to the backboard through the at least one hole in the support plate and through the at least one hole in the at least one half of the foldable backboard.

9. The mobile basketball game system in accordance with claim 7, further comprising a hinge disposed between the two foldable halves of the backboard to enable the backboard to fold between open and folded positions.

10. The mobile basketball game system in accordance with claim 7, wherein:

the top net includes a tube connected to the first and second ends thereof, and the backboard includes an adjustable clamp and pole combination fixed to rear opposite ends thereof, wherein the pole is configured to be adjustable to be raised and inserted into a respective one of the tubes connected to the first and second ends of the top net.

11. The mobile basketball game system in accordance with claim 8, wherein the fastening device is a magnet attached to a backside of at least one of the two foldable halves of the backboard to magnetically attach the support plate to the backboard.

12. The mobile basketball game system in accordance with claim 8, wherein the fastening device is a bracket attached to the backboard to receive and retain the support plate therein.

* * * * *